US008925835B2

(12) United States Patent
Fang et al.

(10) Patent No.: US 8,925,835 B2
(45) Date of Patent: Jan. 6, 2015

(54) MICROFLUIDIC NOZZLE FORMATION AND PROCESS FLOW

(75) Inventors: Ming Fang, Plano, TX (US); Fuchao Wang, Plano, TX (US)

(73) Assignee: STMicroelectronics, Inc., Coppell, TX (US)

( * ) Notice: Subject to any disclaimer, the term of this patent is extended or adjusted under 35 U.S.C. 154(b) by 870 days.

(21) Appl. No.: 12/422,690

(22) Filed: Apr. 13, 2009

(65) Prior Publication Data

US 2010/0163116 A1 Jul. 1, 2010

Related U.S. Application Data

(60) Provisional application No. 61/142,151, filed on Dec. 31, 2008.

(51) Int. Cl.

| | |
|---|---|
| ***B05B 1/24*** | (2006.01) |
| ***B41J 2/16*** | (2006.01) |
| *B41J 2/14* | (2006.01) |

(52) U.S. Cl.

CPC ..... *B41J 2/1601* (2013.01); *B41J 2002/1437* (2013.01); *B41J 2/1646* (2013.01); *B41J 2/1628* (2013.01); *B41J 2/1643* (2013.01); *B41J 2202/16* (2013.01); *B41J 2/1631* (2013.01); *B41J 2/1639* (2013.01); *B41J 2/1629* (2013.01); *B41J 2/14056* (2013.01); *B41J 2/1642* (2013.01)

USPC ..... 239/135; 239/128; 239/552; 392/485; 347/63

(58) Field of Classification Search

CPC .... B05B 9/002; B05B 17/06; B05B 17/0607; B05B 17/0623; B05B 17/0646; B05C 5/001; B05C 11/1042; B41J 2/072; B41J 2/1433; B41J 2/1603; B41J 2/14056; B41J 2/14064; B41J 2/14129

USPC ..... 239/102.1, 102.2, 128, 135, 552; 392/485; 347/47, 63, 64

See application file for complete search history.

(56) References Cited

U.S. PATENT DOCUMENTS

| | | | | |
|---|---|---|---|---|
| 4,513,298 | A * | 4/1985 | Scheu | 347/64 |
| 4,956,653 | A * | 9/1990 | Braun | 347/64 |
| 5,841,452 | A * | 11/1998 | Silverbrook | 347/63 |
| 6,102,530 | A * | 8/2000 | Kim et al. | 347/65 |
| 6,126,846 | A * | 10/2000 | Silverbrook | 216/27 |
| 6,341,848 | B1 * | 1/2002 | Shade et al. | 347/63 |
| 6,561,626 | B1 * | 5/2003 | Min et al. | 347/47 |
| 7,104,632 | B2 * | 9/2006 | Song et al. | 347/61 |
| 7,112,463 | B2 * | 9/2006 | Horning et al. | 438/52 |
| 7,226,148 | B2 * | 6/2007 | Song et al. | 347/63 |
| 7,334,875 | B2 | 2/2008 | Silverbrook et al. | |
| 7,517,059 | B2 * | 4/2009 | Hayakawa | 347/64 |

(Continued)

*Primary Examiner* — Steven J Ganey

(74) *Attorney, Agent, or Firm* — Seed IP Law Group PLLC

(57) ABSTRACT

A method that includes forming a chamber in a substrate, forming a silicon layer overlying the chamber, etching the silicon layer to remove selected regions and retain a selected portion overlying the chamber, the selected portion being at a location and having dimensions that correspond to a location and to dimensions of a nozzle, and forming a first metal layer adjacent to the selected portion. The method also includes forming a path in the substrate to expose the chamber concurrently with removing the selected portion of the silicon layer to expose the nozzle, the nozzle being in fluid communication with the path, the chamber, and a surrounding environment.

17 Claims, 7 Drawing Sheets

(56) References Cited

U.S. PATENT DOCUMENTS 7,881,594 B2 2/2011 Fang et al.
2005/0001884 A1* 1/2005 Hu et al. ..... 347/63
2008/0311307 A1* 12/2008 Bulovic et al. ..... 347/47
2010/0163517 A1 7/2010 Wang et al.

* cited by examiner

MICROFLUIDIC NOZZLE FORMATION AND PROCESS FLOW

BACKGROUND

1. Technical Field

The present disclosure relates to a process of forming a nozzle opening for microfluidic and micromechanical chambers and, more particularly, to forming a nozzle with minimal amounts of gold.

2. Description of the Related Art

In applications using microfluidic structures or micro-electro mechanical structures (MEMS), fluid is often held in a chamber where it is heated. In addition, some fluids are processed at temperatures that need to be accurately regulated. The most common application is inkjet printer heads. Current inkjet technology relies on placing a small amount of ink within an ink chamber, rapidly heating the ink and ejecting it to provide an ink drop at a selected location on an adjacent surface, such as a sheet of paper. Other applications include analyzing fluids with organic components, such as enzymes and proteins, processing biological examinations, and amplifying DNA.

A DNA amplification process (PCR, i.e., Polymerase Chain Reaction process) is one process in which accurate temperature control, including repeated specific thermal cycles, needs to be carried out, while avoiding thermal gradients in the fluid. These organic applications require lower temperatures to process the fluid as compared to the high temperatures for inkjet printers. The different temperatures ranges are achieved by various combinations of microchip heaters.

Generally, generating local heat in a microchip includes heater elements positioned along one side of a chamber to be heated. The fluid is ejected from the chamber toward a target, which requires raising the temperature of the heater high enough to eject the ink and maintain the ink in a heated state as it exits the microchip. The chamber must then cool rapidly so that new fluid can be inserted into the chamber at liquid temperatures.

The current process of forming the ink chamber and nozzle includes forming a sacrificial oxide in a semiconductor wafer, the sacrificial oxide being approximately one micron thick and 200 microns wide. After formation of heater components, a large metal layer, such as gold is deposited and forms walls of the nozzle. The thick metal layer acts as a heat sink and prevents high temperatures from heater components from adversely affecting the durability of the inkjet cartridge or printer components. In some circumstances the heater temperatures may reach approximately 800 degrees Celsius.

The gold layer is approximately 17 microns thick, which corresponds to about 1.5 grams of gold per wafer and 40 grams per lot for 6 inch wafers. Accordingly, manufacturing large quantities of such devices requires large quantities of gold, significantly adding to the cost of manufacturing and the retail price of such devices. In addition, the process to form the large gold layer and define the nozzle is difficult and time consuming. Plus, the nozzle profile depends on the sensitivity of the photo-resist.

In addition to formation of the nozzle, front and back side protection layers are deposited to protect the substrate and device components while an inlet path and the final chamber are formed from the back side of the substrate. These processes complicate manufacturing and are difficult to control. The significant amount of gold, the application of the protection layers, and the sensitivity problem add to the cost of manufacturing and the ultimate retail price of such devices.

BRIEF SUMMARY

The present disclosure describes a method of forming a nozzle for a chamber in a microfluidic structure that handles and processes fluid. The chamber is formed in an integrated circuit in a substrate, which contains an inlet path in fluid communication with the nozzle and a surrounding environment. The fluid is of the type that needs to be heated to selected temperatures for a desired purpose, for example an inkjet printer, DNA amplification, or chemical analysis.

The method includes forming the chamber in the substrate, forming a passivation layer overlying the chamber, and forming a sacrificial layer overlying the passivation layer. Portions of the sacrificial layer are etched, re-exposing the passivation layer and leaving a pillar of sacrificial material positioned overlying the chamber. The pillar is later used to form the nozzle.

Subsequently, a metal layer is deposited on the passivation layer and around the pillar. The pillar is then removed. The metal layer provides the walls of the nozzle once the pillar is removed. The pillar can be removed simultaneously with the formation of the inlet path through a back side of the substrate. Preferably, the metal layer is tungsten, aluminum, or copper. A protection layer is then deposited over the metal layer as a protection from the corrosive properties of the fluid that will pass through the nozzle. The protection layer is significantly thinner than the metal layer. In one embodiment, the metal layer is 15-17 microns thick and the protection layer is 0.2-1 microns.

Formation of the nozzle by forming the sacrificial pillar surrounded by a non-gold metal layer significantly reduces cost and manufacturing time. Since the nozzle profile is defined by the pillar, the complicated and time-consuming process of forming the nozzle in a gold or other metal layer is eliminated. The benefits of the gold layer may be retained by using gold as the protection layer that coats the walls of the nozzle and a top surface of the metal layer. The reduction in quantity of gold used reduces the over all cost of production.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings.

DETAILED DESCRIPTION

Figure 1:
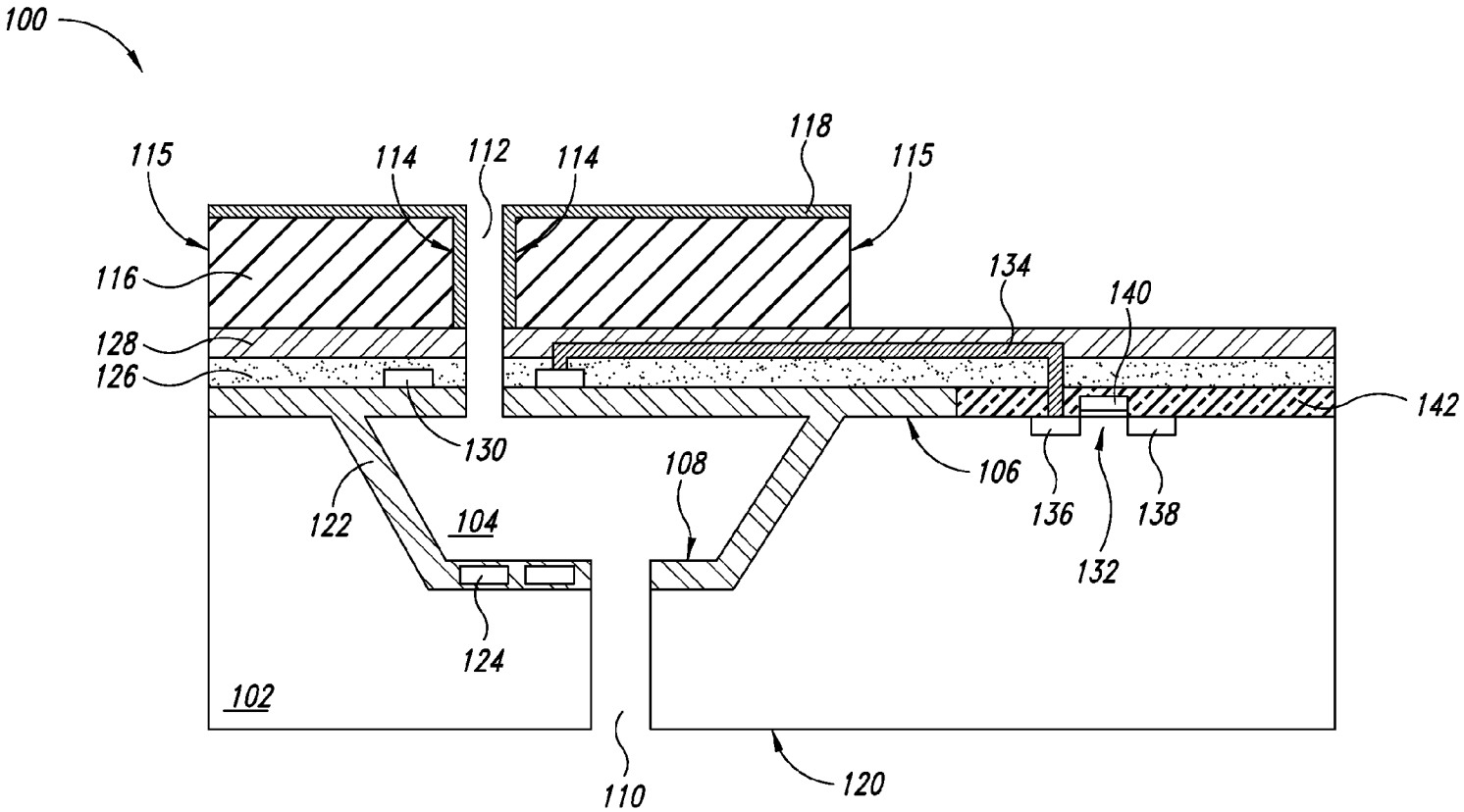
FIG. 1 is a schematic cross-section of a fluid chamber according to one embodiment of the present disclosure.

In the following description, certain specific details are set forth in order to provide a thorough understanding of various embodiments of the disclosure. However, one skilled in the art will understand that the disclosure may be practiced without these specific details. In other instances, well-known structures associated with electronic components and semiconductor fabrication have not been described in detail to avoid unnecessarily obscuring the descriptions of the embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

As used in the specification and appended claims, the use of "correspond," "corresponds," and "corresponding" is intended to describe a ratio of or a similarity between referenced objects. The use of "correspond" or one of its forms should not be construed to mean the exact shape or size.

In the drawings, identical reference numbers identify similar elements or acts. The size and relative positions of elements in the drawings are not necessarily drawn to scale.

Referring to FIG. 1, a microfluidic chamber assembly 100 is illustrated. Generally, microfluidic structures receive fluids from off of the chip for on-chip handling of small volumes of fluid. One common use of such systems is inkjet printer heads.

The chamber assembly 100 includes a chamber 104 formed in a substrate 102. In one embodiment, the chamber 104 has a depth of 20 microns from a top surface 106 of the substrate 102 to a bottom surface 108 of the chamber. The chamber 104 is in fluid communication with an inlet path 110, a nozzle opening 112, and a surrounding environment.

Sidewalls 11 of the nozzle opening 112 are defined by a thick metal layer 116, which may be tungsten, aluminum, or copper. The thick metal layer 116 may be patterned and etched to form support walls 115 for nozzle opening 112. The thick metal layer 116 is coated with a thinner protection layer 118 that acts as a protection from corrosive properties of inks or other fluids ejected from the chamber 104. In a first embodiment, the thin protection layer 118 is gold however; in an alternative embodiment silicon carbide is used. Specific details of the nozzle 112 formation will be discussed in more detail below.

The chamber 104 receives fluid through the inlet path 110 from a back surface 120 of the substrate 102. The path 110 also passes through an insulation layer 122 that surrounds the chamber 104 and houses heater element 124. The nozzle opening 112 passes through the first insulation layer 122, an inter dielectric layer 126, a passivation layer 128, and the thick metal layer 116 coated by the thin protection layer 118.

The heater element 124 resides adjacent the chamber bottom 108 to heat the fluid for ejection through the nozzle 112 into the surrounding environment. Another heater element 130 is positioned adjacent the nozzle opening 112, which aids in facilitating movement of the heated fluid through the nozzle opening 112. Some fluids have a viscosity that makes it difficult for them to flow smoothly into small orifices or into small channels, such as nozzle 112. The size and location of heater elements 124 and 130 can be selected based on desired performance of the device.

A transistor 132 couples to the heater element 130 through a conductive interconnect 134. The transistor 132 may be any suitable switching device to provide electrical current to the heater element 130, such as a metal oxide semiconductor field effect transistor (MOSFET). Interconnect 134 couples to a source region 136 of the transistor 132. A drain region 138 and a gate electrode 140 of the transistor 132 couple to other interconnects, which are not visible in this cross-section. A pre-metal dielectric layer 142 covers the transistor 132.

FIGS. 2-9 illustrate stages of a process to form the chamber assembly in FIG. 1, according to one embodiment of the present disclosure. In this embodiment, the chamber 104 is formed in separate stages from the electronic components, i.e., transistor 132.

The substrate 102 is monocrystalline semiconductor material, for example silicon. The substrate 102 can be doped with a desired conductivity type, either P-type or N-type. In one embodiment, the substrate 102 is 680 microns thick.

Figure 2:
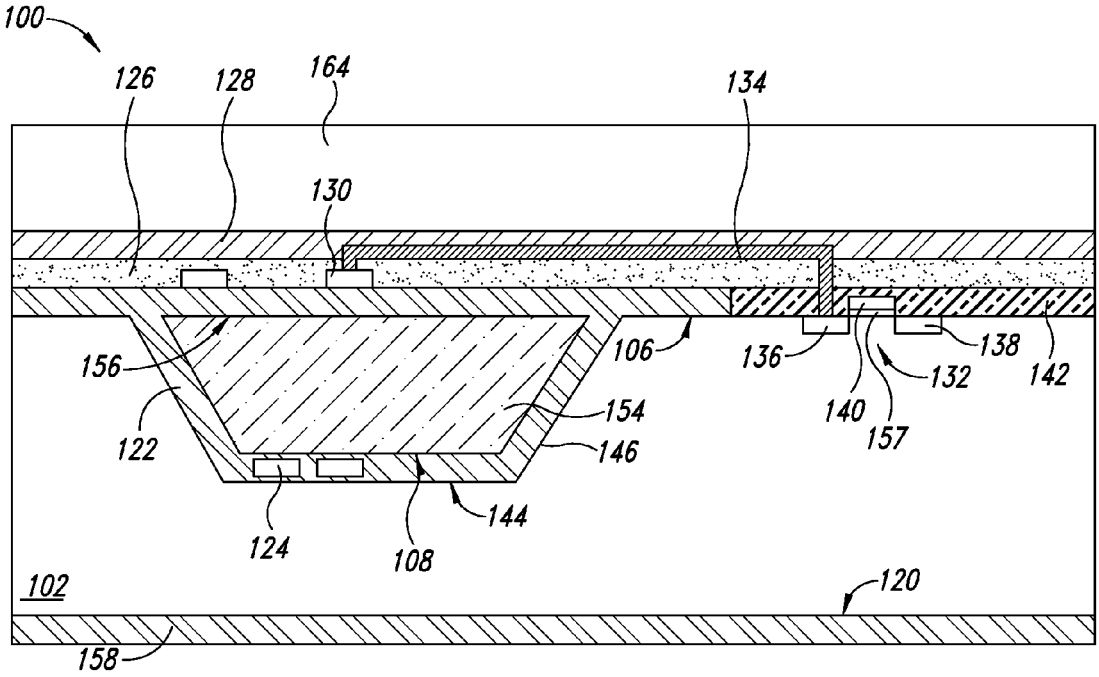
FIGS. 2-9 are schematics of the fluid chamber of FIG. 1 at different stages in a manufacturing process.

As seen in FIG. 2, a recess 146 is formed in the upper surface 106 of the substrate 102 by etching or other acceptable technique. Known etching techniques, including wet etching, dry etching, or a combination of wet and dry etching, are controllable and suitable for etching the shape of recess 146.

In this embodiment, the dimensions of the recess 146 correspond to desired final dimensions of the chamber 104. Recess 146 may have a trapezoidal shape or any shape suitable for the design needs of the ultimate device. The recess 146 has a lower surface 144 that is at least 20 microns below upper surface 106 of the substrate 102. The particular dimensions can be selected prior to formation of recess 146 to meet design and performance specifications for the final device. Other recess shapes and methods of making are also possible. Some of these will be discussed in more detail below (see FIG. 11).

A layer of heater material is deposited and etched to form the heater element 124 in the recess 146. The heater layer may be any suitable material for use with semiconductors that produces heat from electrical resistance. For example, the heater element 124 may be Tantalum or Tantalum Aluminum (TaAl). In an alternative embodiment, the heater layer may be a high-temperature metallic heater such as an alloy that contains one or more of nickel, silver, or molybdenum, in various combinations. A metal oxide, ceramic oxide, or other sophisticated resistive metal heater element may also be used.

The heater element 124 can be any suitable shape that promotes consistent heating of the chamber 104. For example, the heater element 124 can be a torus shape, a hollow cylindrical shape, a solid shape, a square, a rectangle, a star with an opening in the center, a plurality of fingers, or any other suitable shape. In the illustrated embodiment, the heater element 124 is a square-edged torus shape.

Subsequently, the insulation layer 122 is formed, either by growth or deposition, over the heater element 124. The insulation layer 122 completely covers the heater element 124 and forms the bottom surface 108 of the chamber 104. In embodiments where heater 124 is included below chamber 104, the chamber is initially made deeper and larger by an amount equal to what the heater element 124 and layer 122 will add.

The insulation layer 122 is a combination of layers, such as a pad oxide layer and a nitride layer or equivalent layer. The pad oxide layer and the heater element 124 may be covered by the nitride layer, which may have a thickness in the range of 50 to 3,000 Angstroms. The nitride layer may also be deposited in layers, which can include a layer of low-stress nitride. The insulation layer 122 thus may include an oxide directly on the silicon and a nitride deposited on top of the oxide, the nitride being 2 to 30 times thicker than the oxide.

The dielectric layer 122 preferably includes a hard and durable material, which does not deteriorate despite its thickness and can be subjected to high temperatures. In addition, dielectric layer 122 should be resistant to the etch chemistry used to form the path 110 through the substrate 102. In one embodiment, the dielectric layer 122 includes low-stress nitride, deposited using low-stress nitride deposition methods as are known in the art. Dielectric layer 122 may also be carbide or other inert, hard material.

In another embodiment, the dielectric layer 122 can be grown around the heater 124. The dielectric layer 122 electrically isolates the upper surface of the substrate 106. It can be a material with desirable heat transfer properties to reduce heat from the heater element 124 and prevent the heat from spreading to substrate 102 around the chamber 104.

A sacrificial material 154 is deposited into the recess 146 in the substrate 102. The sacrificial material 154 can be any material which can withstand subsequent process steps for formation of the integrated circuit (IC) components and can be subsequently removed from the recess. Preferably, the sacrificial material 154 has a low melting temperature so that the material 154 fills the cracks and corners of the recess 146 evenly. Some examples of the sacrificial material 154 include oxides, tetra ethyl ortho silicate (TEOS), borophosphosilicate glass (BPSG), or spin-on glass.

An upper surface 156 of the sacrificial material 154 and the upper surface of insulation layer 122 may be processed to make the upper surface 156 and insulation layer 122 coplanar with the upper surface 106 of the substrate 102. This may be achieved by a chemical mechanical planarization (CMP) technique or other technique suitable to planarize the sacrificial material 154.

Once the upper surface 106 is re-exposed, the transistor 132 is formed in the exposed substrate 102 at a location spaced from the sacrificial material 154. The transistor 132 includes the source region 136, the drain region 138, and the gate electrode 140, which are fabricated using conventional IC process techniques that are well known and will not be described in detail. A thin dielectric layer 157 separates the gate electrode 140 from the substrate 102.

The dielectric layer 157 is formed on the upper surface 106 of the substrate 102, extending at least between the source region 136 and the drain region 138. The gate electrode 140 forms on the dielectric layer 157 for controlling current as will be discussed in more detail below with respect to electrical communication between the transistor 132 and the heater element 130. The dielectric layer 157 may include a silicon dioxide, a silicon nitride, a sandwich layer of silicon dioxide and silicon nitride, or some other combination of suitable dielectric material.

The gate electrode 140 can be any acceptable conductive material, such as polysilicon, polysilicon with a silicide layer, metal, or any other conductive layer that is compatible with the process of the present disclosure. The process technology and steps for forming such are known. The transistor 132 can be of any suitable type, such as a MOSFET of LDMOS, VDMOS, etc.

Another insulation layer is deposited or grown over the upper surface 106 of the substrate 102 and over the top surface 156 of the sacrificial material 154. The insulation layer over the sacrificial material 154 can be the same material as the insulation layer 122 beneath and around the sacrificial material 154. These two insulation layers may merge as shown. In another embodiment, the insulation layer over the sacrificial material 154 can be of a different material than the insulation layer beneath the sacrificial material 154.

As previously noted, the insulation layer 122 can be a combination of layers, such as a nitride, a layer of oxide, and a low-stress nitride. The insulation layer 122 thus may include an oxide directly on the silicon and a nitride deposited on top of the oxide. Instead of a deposition technique, in some embodiments the insulation layer 122 can be grown on the upper surface 106 of the substrate 102. The insulation layer 122 electrically isolates the upper surface 106 of the substrate 102 from the other components.

A back side insulation layer 158 is deposited on the back surface 120 of the substrate 102 as a protection layer for subsequent process steps. The back side insulation layer 158 may be formed of the same low-stress nitride as the insulation layer 122 on the upper surface 106 of the substrate 102 or the insulation layer 158 may be grown. The application of the insulation layer 122 and the back side insulation layer 158 can be in a batch process technique so that both layers evenly coat the wafer in one process.

Figure 9:
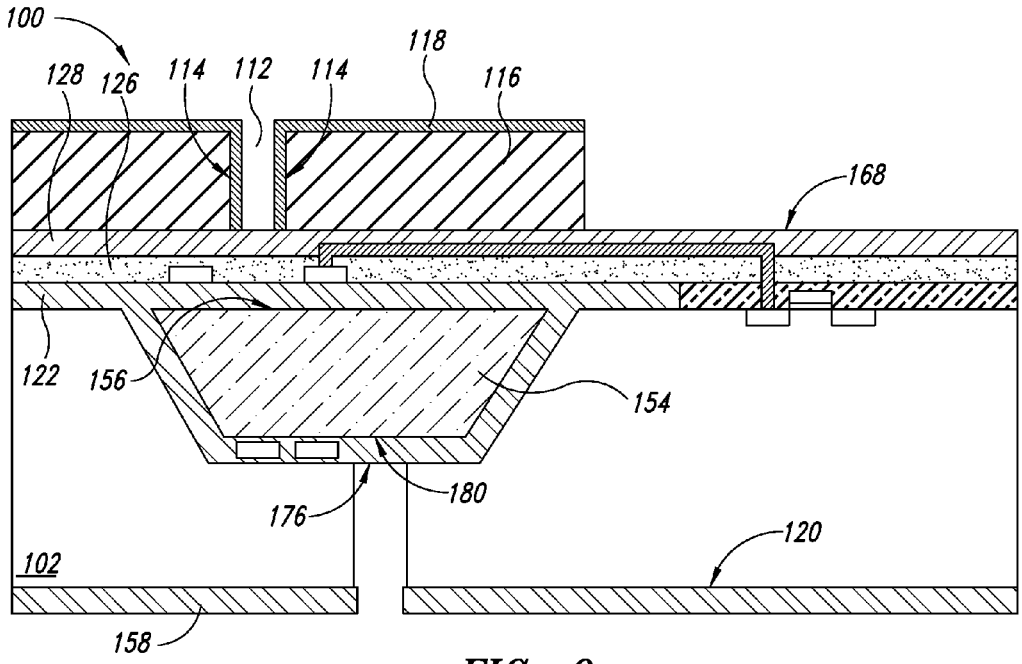

The insulation layer 122 is patterned and etched to expose the transistor 132 if a different layer is formed over the transistor. Alternatively, it can be left in place and also used as the passivation layer over the transistor. If the layer 122 is etched, a pre-metal dielectric layer 142 is deposited over the transistor 132, as shown in FIG. 9. After deposition, the insulation layer 122 and the pre-metal dielectric 142 may be planarized by CMP or other suitable technique. However, the heater element 130 may be formed without planarizing the insulation layer 122 and the pre-metal dielectric layer 142.

Subsequently, the second heater element 130 is formed by depositing and etching a layer of heater material on the insulation layer 122. The etching leaves behind only a portion of the heater element 130 aligned over the sacrificial material 154 in the recess 146. As described above, the second heater element 130 may be formed of the same material as the lower heat element 124, such as TaAl. In another embodiment, the heater element 130 is polysilicon, which can be deposited in the same process as the gate 140. If the gate 140 is doped, the polysilicon for the heater element 130 will not be doped, so that it is comprised of intrinsic polysilicon. Alternatively, the heater element 130 may have very light levels of dopant of P- or N-type so as to slightly increase the resistance and improve the heater properties. The thickness of the heater element 130 may be a different thickness than the gate 140, since the purpose is to function as a heater rather than as a highly conductive gate member. In such situations, even though both layers are poly, they may be deposited in separate steps.

The position of the heater element 130 is above the chamber 104 and adjacent the location of the expected nozzle opening 112, as shown in FIG. 1. The nozzle opening 112 will be described in more detail below. In an alternative embodiment, the heater element 130 may be omitted so the assembly only has heater element 124 below the sacrificial material 154 in the recess 146.

In embodiments which have more than one heater element, the fluid in the chamber 104 is heated by the first heater 124 and by second heater element 130. The lower heater 124 heats the fluid above a selected threshold, to heat the fluid entering the chamber 104 from a manifold, or stored in the chamber 104. The first heater 124 biases the fluid toward the nozzle 112 and projects the fluid out toward the surrounding environment. The second heater element 130 can selectively generate heat above the threshold to facilitate movement of fluid through the nozzle 112 away from the chamber 104.

The inter dielectric layer 126 is deposited on the heater element 130, the insulation layer 122, and the pre-metal dielectric layer 142. A via is etched through the inter dielectric layer 126 and the pre-metal dielectric layer 142 to expose a surface of the source 136 of transistor 132. A via is etched through the inter dielectric layer 126 to expose a surface of the heater 130.

Figure 11:
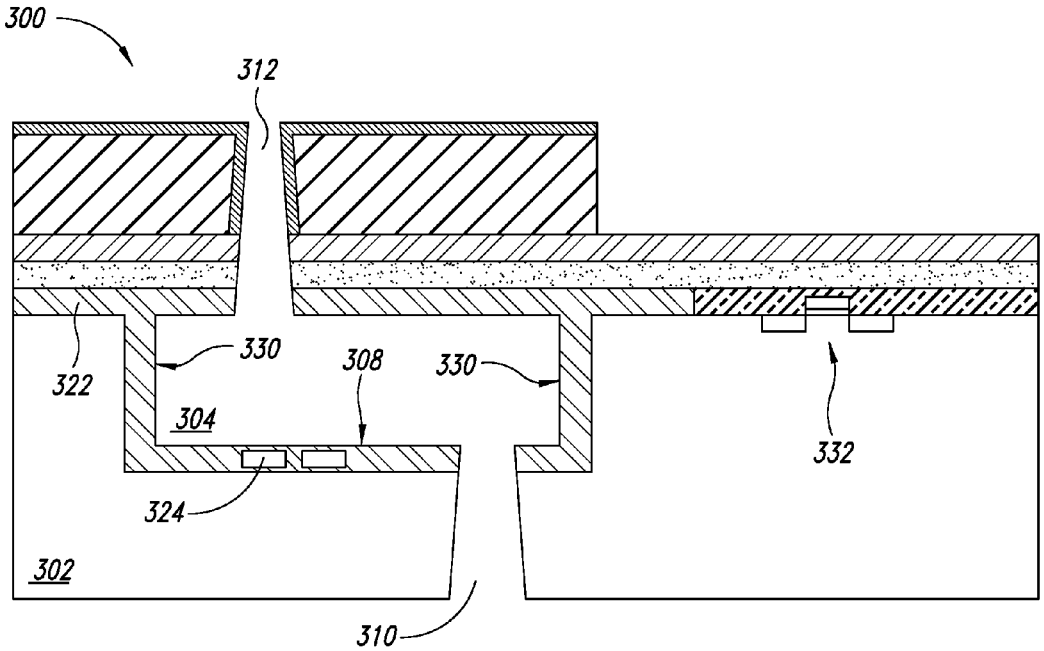
FIG. 11 is an alternative embodiment of the fluid chamber and nozzle of FIG. 1.

Electrical current from the transistor 132 is supplied to the heater element 130 through vias and interconnect structure 134 (see FIG. 11). The vias can be filled with a conductive plug, such as tungsten, with a Ti/Ni liner, or filled with another acceptable conductor. This is followed by deposition of a conductive layer, such as a metal, for example doped aluminum, silicon doped copper, tungsten, or combinations thereof, followed by etching to create the interconnect structure 134. The interconnect structure 134 is selected to be of a material and size such that it will not significantly heat up while carrying the current to the heater element 130. The electrical components and interconnect for heater element 124 are not shown in this cross section and are formed with similar process techniques.

The process for forming the control circuitry, including the transistors, on the same substrate as heating chambers is well known in the art and the details will therefore not be described. Any of the many known and widely practiced techniques for forming the MOSFETs and other circuits on the substrate 102 with the chamber 104 may be used.

After formation of the control circuitry is complete, the passivation layer 128 is deposited to isolate the transistor 132 and interconnect structure 134. The passivation layer 128 is applied over the dielectric layer 126 and the interconnect structure 134. The passivation layer 128 may be a nitride, a phosphosilicate glass followed by a nitride, a stack of oxide-nitride-oxide, a stack of silicon-oxide-nitride, or other compatible inter-metal insulating layer. In one embodiment, the total height of layers 122, 126, and 128 is one micron. As compared to the chamber depth of 20 microns, the stack of layers is very small.

Subsequently, a sacrificial layer 164 is deposited over the passivation layer 128. In one embodiment, the passivation layer 128 is planarized by CMP or other comparable process before deposition of the sacrificial layer 164. The sacrificial layer 164 is deposited with a thickness that corresponds to the desired height of the final nozzle 112. In one embodiment, the thickness of the sacrificial layer 164 is 15-17 microns.

The sacrificial layer 164 can be any suitable material which can withstand subsequent process steps for release of the chamber 104. Preferably, the sacrificial layer 164 is an amorphous silicon layer. Other materials include oxides, tetra ethyl ortho silicate (TEOS), borophosphosilicate glass (BPSG), or spin-on glass.

Deposition of the amorphous silicon is advantageous for its low cost, controllability, and speed. In addition, amorphous silicon is easier to process when forming the nozzle 112. Preferably, the amorphous silicon is undoped to avoid interaction issues with subsequent metal layers, such as tungsten.

Figure 3:
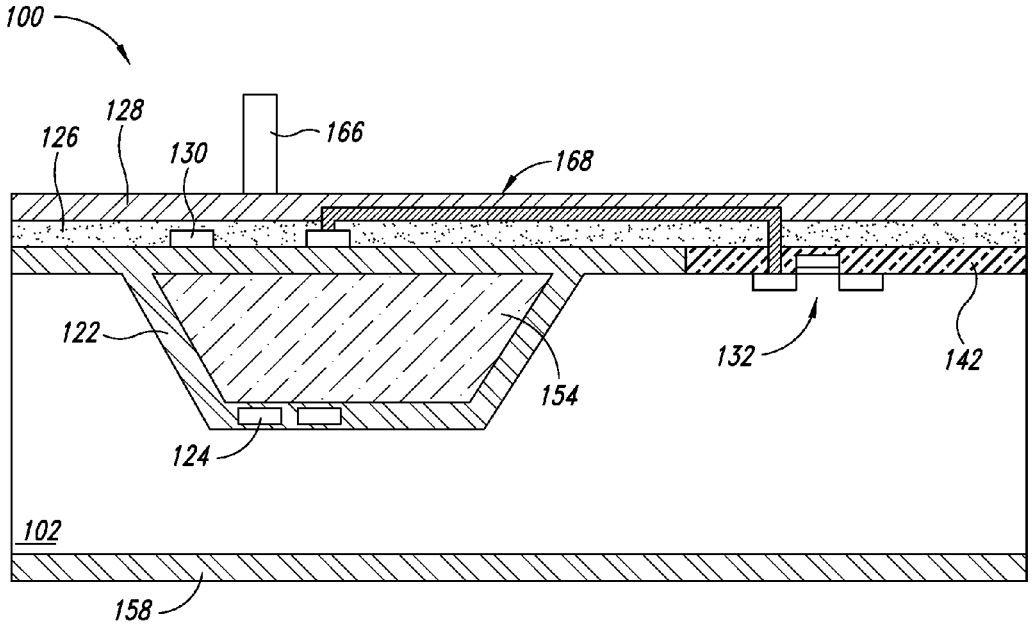

As illustrated in FIG. 3, the sacrificial layer 164 is patterned and etched to form a pillar 166 positioned overlying the sacrificial material 154 in the recess 146 and aligned with the heater element 130. The etch re-exposes the top surface 168 of the passivation layer 128. In the embodiment utilizing amorphous silicon as the sacrificial layer 164, a high speed plasma etch technique can be utilized to quickly process the silicon and form pillar 166. In addition, this technique can produce precise dimensions of the pillar 166 which correspond to dimensions of the nozzle 112. Another technique which can be utilized to form the pillar 166 is plasma enhanced chemical vapor deposition (PECVD) enhanced with microwaves.

In one embodiment, the heater element 130 has a toroidal shape and possesses a central axis. In this embodiment, the pillar 166 is preferably aligned on the central axis of the heater element 130, so that when the nozzle 112 is formed, it will be surrounded by the heater element 130.

The pillar 166 in FIG. 3 is illustrated as rectangular. However, the pillar 166 may be formed in a variety of shapes to meet various design needs (see FIGS. 10 and 11). Alternate pillar shapes will be discussed in more detail below.

Figure 4:
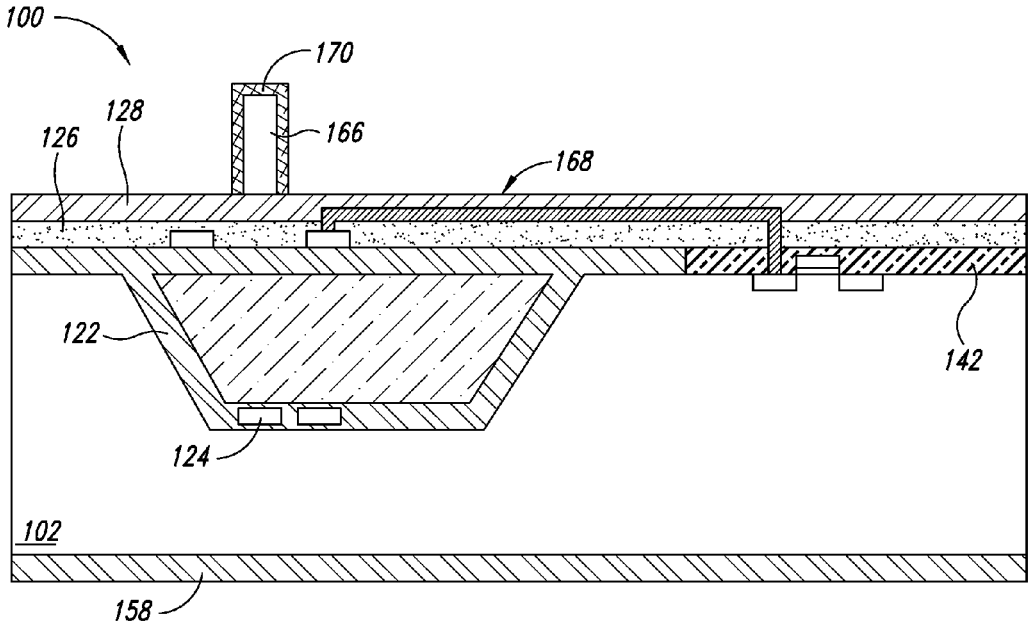

FIG. 4 illustrates a protection layer 170 grown or deposited over the pillar 166. The protection layer 170 may be an oxide or other suitable material that can protect the sacrificial material during subsequent stages of the process. The protection layer 170 completely covers the pillar 166 and is flush with the passivation layer 128. The protection layer 170 can be made by a number of acceptable techniques. For example, the protection layer 170 can be grown as an oxide layer on the polysilicon, be deposited on the polysilicon as an oxide, nitride, or other layer, or other acceptable technique to form the protection layer 170. Known methods, which include etching steps, such as dry etching, wet etching, lithography, potassium hydroxide etching, or a combination thereof are used to form the protection layer 170.

The protection layer 170 is optional depending on the selection of the material for the sacrificial layer 164 and the subsequent layers. In embodiments where the protection layer 170 is used, the pillar 166 size and shape are adjusted to account for the additional width the protection layer 170 adds to the final width of the nozzle 112. The thickness of the protection layer 170 should not cause the nozzle 112 to interfere with the performance of the heater element 130.

Figure 5:
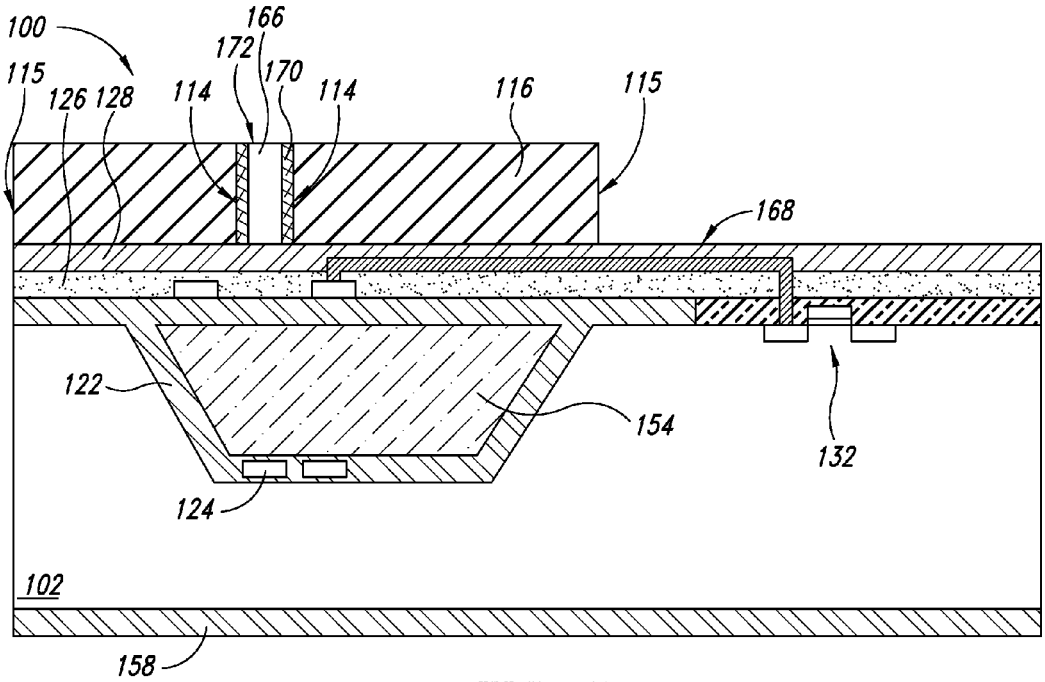

In FIG. 5, the metal layer 116 is deposited over passivation layer 128 and around the protection layer 170 around the pillar 166. The metal layer 116, which functions as a heat sink, can be deposited with a CVD technique or any other conventional deposition method. The metal layer 116 is positioned overlying the sacrificial material 154 in the recess 146, the heater element 130, and on all sides of the pillar 166 covered by protection layer 170. The metal layer 116 is deposited over the protection layer 170 and then both layers are etched, planarized, or polished back to expose a top surface 172 of the pillar 166.

Next, a photoresist mask is applied and patterned. The metal layer 116 is then etched using the pattern from the photoresist to form the desired shape for support walls 115 for the nozzle. For example, it may expose the top surface 168 of the passivation layer 128 at selected locations spaced from the nozzle 112 and above the transistor 132. In a preferred embodiment, the metal selected for layer 116 is a type of material that can be deposited and then patterned and etched using standard semiconductor techniques. For example, tungsten, aluminum, titanium and the like can be deposited and then patterned and etched using well known semiconductor techniques. On the other hand gold is electroplated, usually on a seed layer, and is not susceptible to deposition using CVD or sputtering. Also, gold cannot be etched by standard semiconductor etch techniques, rather, higher cost steps are needed to etch gold to a desired shape. The use of metal for layer 116 of the type that can be deposited and patterned and etched using standard semiconductor techniques greatly reduces the cost and complexity for making the product. This large metal heat sink is included because the devices heat fluid from one location which is distal with respect to the location at which the fluid exits the device. Accordingly, in existing devices, extremely high temperatures, such as 800° C., are applied to the chamber 104 and fluid, which heats the entire surrounding region. This heat needs to be effectively absorbed to protect adjacent and external components, for example other chambers, transistors, and components external to these heaters in inkjet printer heads.

Existing art devices are known to use gold as metal layer 116. In a preferred embodiment, the metal layer 116 is tungsten. Other suitable metal layers include aluminum, aluminum alloys, or copper. Typically, the metal layer 116 is a material that exhibits superior heat absorption and dissipation qualities. Forming metal layer 116 from tungsten, aluminum, or copper and eliminating the large expensive layer of gold significantly reduces the cost per wafer.

Figure 6:
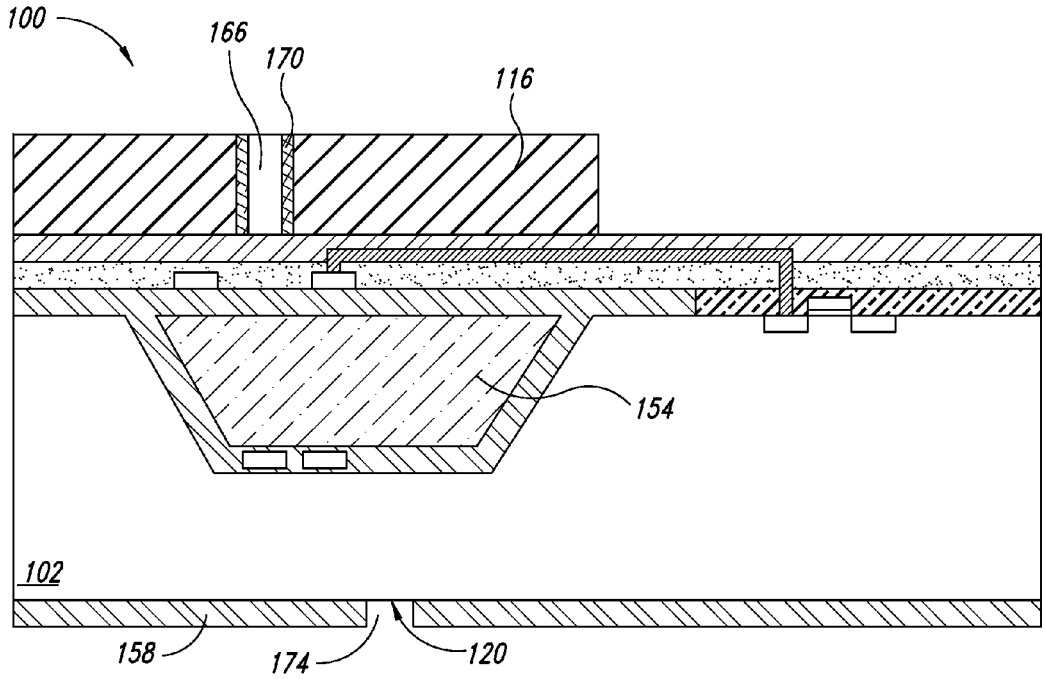

In FIG. 6, the back side insulation layer 158 is patterned and etched to form opening 174 and to re-expose the back surface 120 of the substrate 102. The opening 174 is positioned below the sacrificial material 154 in the recess 146 at a location away from the pillar 166. The location of the opening 174 indicates where the path 110 will be formed through the substrate 102.

Figure 7:
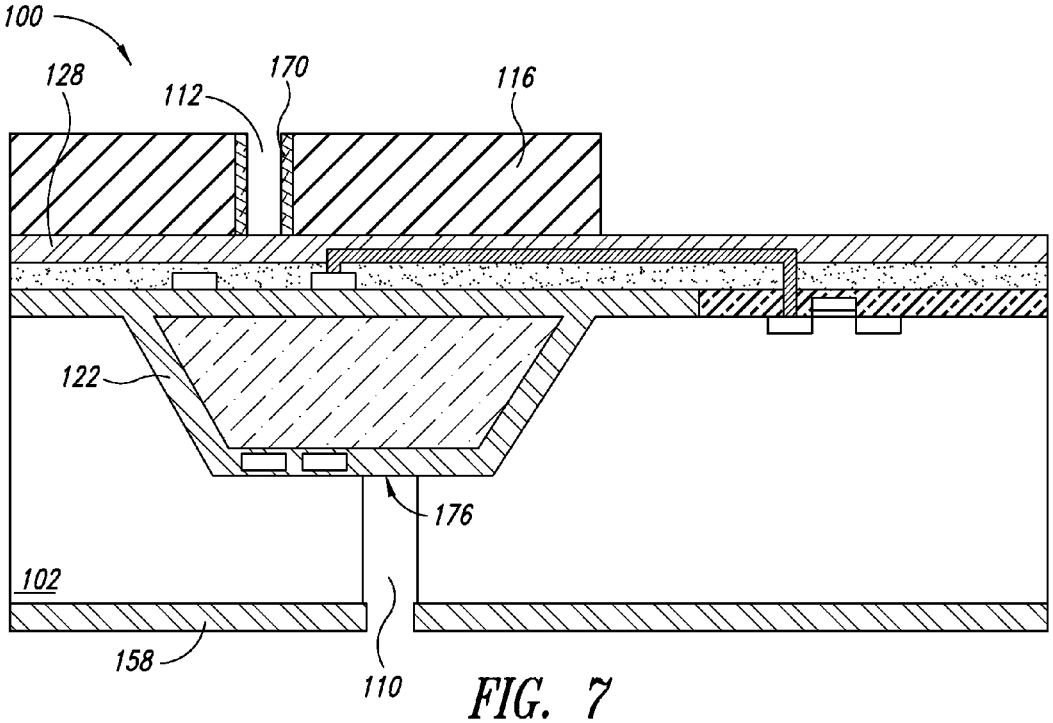

In FIG. 7, the path 110 through the substrate 102 exposes a bottom surface 176 of the insulation layer 122 and is formed by etching the substrate 102 through the opening 174. The path 110 has vertical sidewalls; however, other angled sidewalls are acceptable using known techniques in the art (see FIG. 11).

The path 110 and the pillar 166 are concurrently or simultaneously removed by the etch technique. By releasing the nozzle 112 and forming the path during the same process, several process steps are eliminated. Advantageously, this method decreases the manufacturing cycle time, decreases the complexity of the process, increases yield, and reduces costs. After formation of the metal layer 116, no protection layer is needed over the front side components because the path 110 and the pillar are removed in the same stage of the process.

The path 110 is formed using etching steps, such as dry etching, wet etching, layer formation, deposition, lithography, potassium hydroxide etching, or a combination thereof. In one embodiment, a potassium hydroxide (KOH) etch is used to form the path 110 and remove the pillar 166 without affecting passivation layer 128 or insulation layer 122. In one embodiment, the path 110 can ultimately have vertical sidewalls if a second KOH etch is not required to form the final chamber shape.

Figure 8:
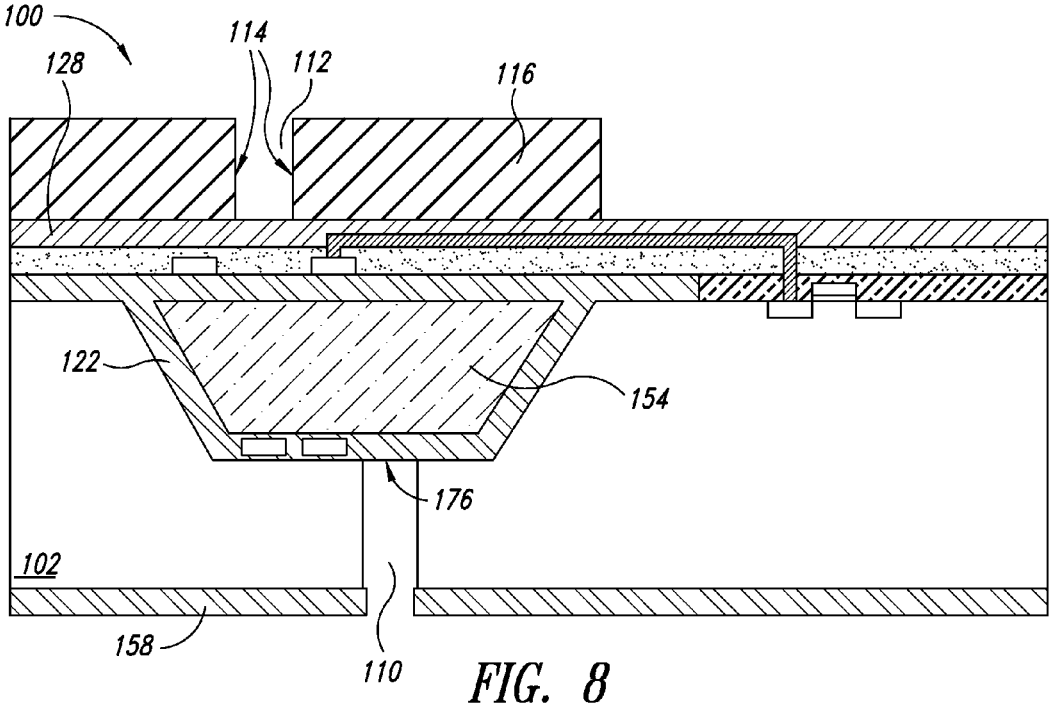

In FIG. 8, the protection layer 170 is removed to expose sidewalls 114 of the nozzle 112. A hydrogen fluoride dip or other conventional method may be used to remove protection layer 170 from the nozzle 112. In embodiments where the protection layer 170 is omitted, the sidewalls 114 of nozzle 112 would be exposed upon removal of the pillar 166 from within the metal layer 116.

Once the sidewalls 114 of the nozzle 112 are exposed, the protection layer 118 is formed over the metal layer 116 and along sidewalls 114 of nozzle 112. The protection layer 118 does not cover the top surface 168 of the passivation layer 128. Preferably, the protection layer 118 is a thin layer of gold or other material with anti-corrosive properties, such as a layer of silicon carbide or a diamond-like film. The material selected for protection layer 118 depends on the corrosive properties of the liquid held in the chamber 104 and should be a hard material that does not corrode in the presence of the liquid. If gold is utilized, electroplating techniques may be used to form the protection layer 118. Alternatively, gold can be applied by sputtering onto a tungsten-titanium layer or a titanium layer for adhesion or by an evaporation technique. Alternatively, silicon carbide may be deposited using standard chemical vapor deposition, plasma, or other techniques. Advantageously, silicon carbide may be patterned and etched subsequent to deposition using standard semiconductor processing techniques.

The protection layer 118 has a uniform thickness of approximately 2,000-10,000 angstroms (i.e., 0.2-1 microns). The thin layer 118 acts as a barrier against corrosive qualities of ink or other fluid held in the chamber. The protection layer 118 protects the other metal layer 116 from subsequent processes. In addition, this method reduces costs by minimizing the amount of gold by keeping the protection layer 118 thin and not covering the portion of the wafer housing the electronic components.

Subsequently, the nozzle 112 is etched to re-expose the top surface 156 of the sacrificial material 154. In an alternative embodiment, the top surface 156 may be exposed prior to formation of the protection layer 118 so that the protection layer 118 protects the passivation layer 128, the inter dielectric layer 126, and the insulation layer 122. The back surface 176 of the insulation layer 122 is also etched to expose a back surface 180 of the sacrificial material 154. The back surface 176 of the insulation layer 122 may be etched simultaneously with, prior to, or concurrently with the etch of nozzle 112 to expose the top surface 156. In addition, the back side insulation layer 158 is removed to re-expose the back surface 120 of the substrate 102.

As illustrated in FIG. 1, the sacrificial material 154 is removed from the recess 146. The chamber 104 has a trapezoidal shape with a larger area at the upper portion than at the bottom portion. An etch technique is used to remove the sacrificial material 154. One technique which may be utilized is a hydrogen fluoride (HF) etch. The protection layer 118 protects the metal layer 116 from the HF, particularly when the protection layer 118 is gold and the metal layer 116 is tungsten. The HF etch removes materials such as TEOS and BPSG, but does not significantly affect the substrate 102 or the protection layer 118. The removal of the sacrificial material 154 exposes the bottom surface 108 of the chamber 104.

In an alternative embodiment, forming the final nozzle 112 can occur simultaneously with the removal of the sacrificial material 154 during the HF etch. However, the final nozzle 112 may be formed prior to or concurrently with the removal of the sacrificial material 154.

Alternatively, the chamber 104 may be formed by initially forming a smaller recess than recess 146, approximately 1 micron thick. The smaller recess is then filled with a sacrificial material, such as BPSG. The nozzle 112 is formed by depositing and etching a sacrificial layer to form a pillar as described above. After formation of the path 110 and removal of the pillar with a first KOH etch, an HF etch is used to form the remainder of the nozzle 112 and to remove the sacrificial material from the chamber. Then a second KOH etch is used to form the final chamber shape. Regardless of how the chamber is formed, this method reduces complexity and costs associated with forming the nozzle 112.

Figure 10:
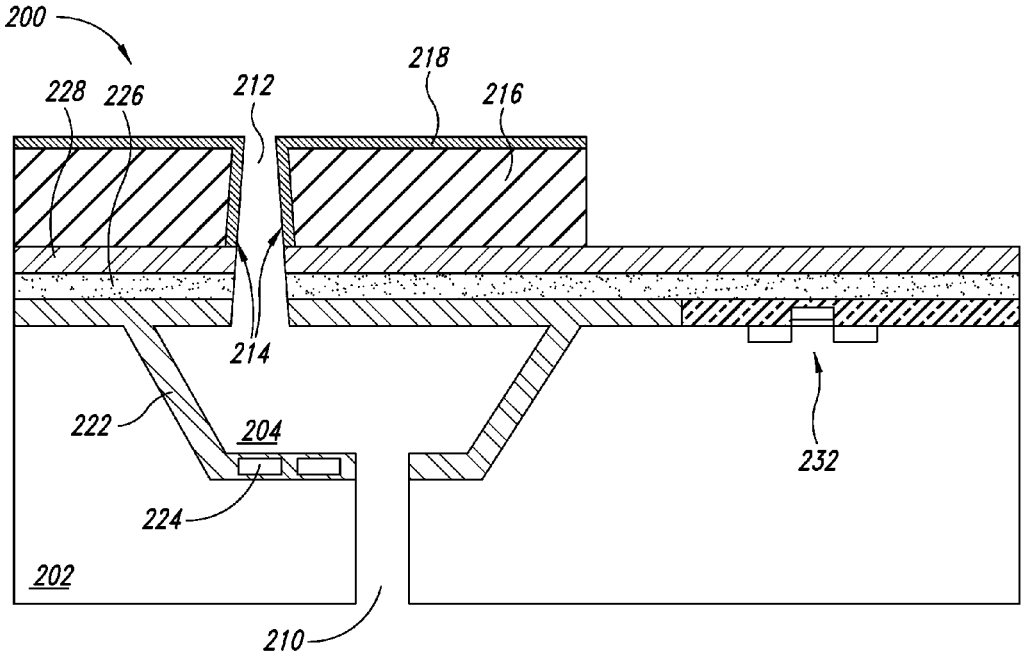
FIG. 10 is an alternative embodiment of a nozzle for the fluid chamber of FIG. 1.

FIG. 10 illustrates an alternative embodiment of a chamber assembly with a different nozzle 212 shape. A chamber 204 is formed in a substrate 202 and is in fluid communication with a path 210 and nozzle 212. A heater element 224 is formed in an insulation layer 222 that surrounds chamber 104. A transistor 232 couples to heater element 224 with a metal interconnect not shown in this cross section. The process of forming the chamber 204 and transistor 232 is the same as the process described above with respect to FIGS. 1-9.

The nozzle 212 has sidewalls 214 coated partially with protection layer 218. The sidewalls 214 are formed at a slight angle. The distance between the sidewalls 214 gradually decreases as the sidewalls 214 travel away from the point where they depart from the chamber 204. This shape can be referred to as a "cannon," where a bottom diameter (a) is larger than a top diameter (b). In one embodiment, the ratio of 'a' to 'b' is 1 to 2.5. In alternative embodiments, the nozzle 212 is cylindrical, has a square orifice, a tapered orifice with a cylindrical exit portion, or is triangular. In one embodiment, the nozzle 212 has a diameter of 10 microns. The nozzle 212 shape can be various shapes because of the sophisticated deposition and etch techniques available to form the pillar.

FIG. 11 is an alternative embodiment of the present disclosure with an alternative shape for a chamber 304, nozzle 312, and path 310. A chamber assembly 300 includes the chamber 304 formed in a substrate 302 having a heater element 324 formed below the chamber 304 in an insulation layer 322. The chamber 304 is rectangular in shape with vertical sidewalls 330. The chamber 304 can be various shapes that include an annular shape, a long tube with either cylindrical or curved sidewalls, a truncated cone, or other cone shape. In other embodiments, the chamber is in the form of a prism, which may include various geometrical prism shapes, such as a cuboid, a right prism, an oblique prism, or other acceptable shapes depending on the particular fluids and the particular uses.

The insulation layer 322 surrounds the heater element 324 near a bottom surface 308 of the chamber 304. The heater element 324 is formed by techniques as discussed above. In one embodiment, the insulation layer 322 is conformally deposited over the heater element 324 and over an upper surface of the substrate 302. The insulation layer 322 is deposited in a manner such that the profile of the recess is substantially preserved, for example a nitride is deposited substantially conformally. The insulation layer 322 covers the heater element 324 and provides a bottom surface 308 of chamber 304. The thickness of the heater element 324 is smaller than the chamber depth.

There are many acceptable techniques to couple the first heater element 324 in the bottom of chamber 304 to a transistor 332 that provides the heating current. Such connections are common in the prior art and any known technique that electrically couples the transistor 332 to the heater element 324 is acceptable. The connection is not visible in this cross section.

The path 310 illustrates an alternative path shape with angled sidewalls. Manufacturers can select the path shape 310 to meet the needs of the device. This method reduces manufacturing time and costs by deleting steps of the method. A front side protection is unnecessary after depositing the metal layer around the pillar and before forming the path through the substrate. In fact, the sacrificial material in the nozzle can be removed in the same process as forming the path through the substrate.

Figure 12:
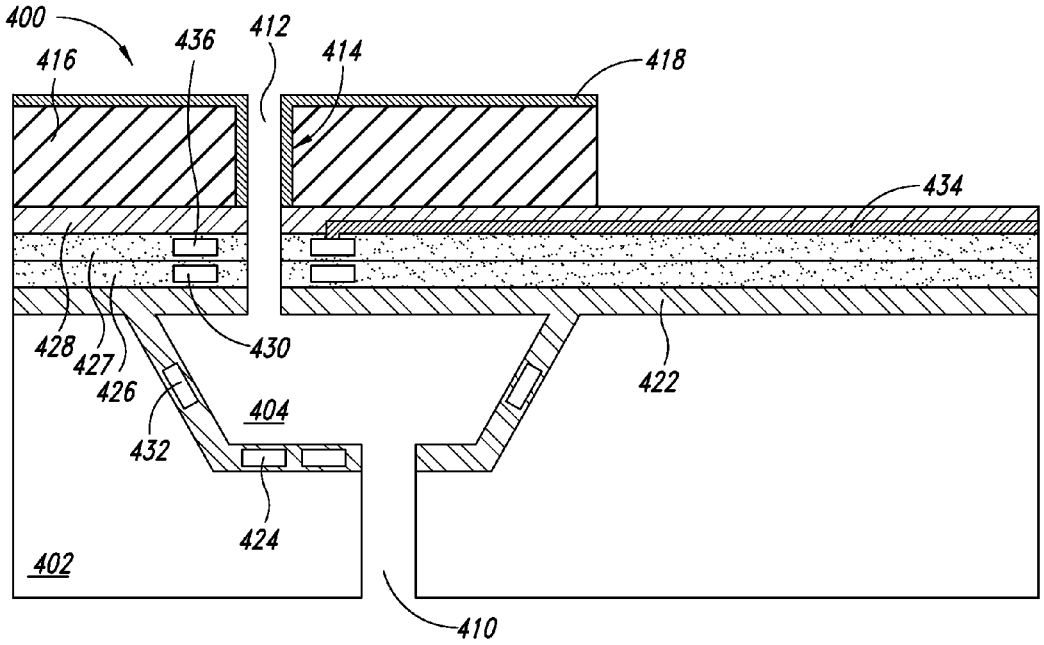
FIG. 12 is another alternative embodiment of the fluid chamber and nozzle of FIG. 1.

For embodiments processing organic fluids at lower temperatures and that require controlled temperature changes, additional heater elements may be placed along nozzle 412 or at different locations adjacent chamber 404, as shown in FIG. 12. Integrated heating assembly 400 includes third and fourth heater elements 432, 436 in addition to first and second heater elements 424, 430. Heater element 436 is coupled to conductor 434 and positioned between the heater element 430 and an open end of the nozzle 412 toward the surrounding environment such that the fluid can be heated further or more consistently, and in some embodiments, at lesser heat per heater element. For example, heater element 430 can operate at 250° C. while heater element 436 operates at 150° C., reducing the need for a heat sink adjacent the nozzle 412.

In one embodiment utilizing multiple heaters 430, 436 stacked adjacent the nozzle 412, the thickness of the metal layer 416 can be decreased to form a smaller heat sink. Advantageously, by decreasing the size of the metal layer 416 the amount of the metal protection layer 418 utilized is also decreased.

As illustrated in FIG. 12, the heater elements can be vertically positioned or vertically stacked with respect to each other. As can be seen, the heater element 424 is the lowest of the stack, and the heater element 432 is positioned above and in this embodiment to the sides of the heater element 424. It is thus in a second vertical position above the vertical position of the heater element 424. The heater elements 424 and 432 more precisely heat the chamber 404.

The heater elements 430 and 436 are also vertically above the heater element 424. With respect to these two heater elements 430, 436, they are vertically stacked directly above each other. Thus, in this particular arrangement it forms a vertical stack, with each of the heater elements in different horizontal planes, but being aligned with each other such as heater elements 430 and 436, or having some vertical plane which is overlapped between the heater elements such as 424 and 430, which, although they overlap, do not align at one or both edges.

Heater elements 430, 436 are formed as described above with respect to FIGS. 1-9. An inter dielectric layer 426, 427 is deposited around the heater elements 430, 436; however, any suitable insulation layer may be used.

Alternatively, or in addition, the heater element 436 can be positioned such that it extends adjacent a lateral periphery of the chamber 404, assisting the heater element 424 in heating the chamber 404. In such an embodiment, the heater element 424 can operate at even lesser temperatures since it is being aided by the heater element 436. For example, the heater element 424 can be heated to 300 degrees Celsius while the heater element 436 is heated to 250° C.

The alternative embodiment of FIG. 12 is particularly beneficial for DNA amplification. In such uses, precise temperature control of the fluids is important over a range of temperatures. At some stages, the fluid needs to be quite hot to amplify the DNA, while it cannot exceed the temperature at which the fluid becomes denatured. The fluid must be heated and cooled for a series of cycles over a range of temperatures, as is known in the art. In some applications, the temperature of the fluid must range from a high of 90° C. to 80° C., to a lower range, for example 60° C. to 50° C. with various temperatures higher and lower being required at different times in the cycle.

The use of multiple heaters on the chamber is beneficial to provide precise controls with rapid response and less of a temperature gradient in the fluid. Having a uniform temperature throughout the entire fluid is important in some DNA amplification applications, and the use of the multiple heaters is beneficial to provide a uniform temperature gradient. Further, in DNA amplification, it is not desired to eject the fluid from the nozzle 412 by overheating it, so the heaters may be positioned differently to achieve the uniform heating that is desired.

The additional heater element 436 adjacent nozzle 412 may also be advantageous in the embodiments with different viscosities of fluid in chamber 404. Some fluids have viscosities that prevent the fluid from smoothly flowing into a small orifice or into a small channel, such as nozzle 412. Having the heater element 436 positioned near the nozzle 412, even if slight, reduces the viscosity and provides a more even flow of the fluid. This may advantageously permit more accurate ejection of the fluid from the chamber 404, since the fluid may smoothly flow and reduce or void altogether any clogs or plugs which may occur.

Even for fluids which would easily flow from chamber 404, the use of the additional heater 436 may sufficiently increase the rate at which fluid can be expelled from chamber 404. If desired, a minimum low heat may be maintained on the fluid by having the heater 424 at a very low heat temperature, thus maintaining the fluid having a constant. Alternatively, the fluid may be permitted to cool, increasing its viscosity and thus making it easier to keep within chamber 404 and reduce the likelihood that some may leak out of either orifice 412 or 410.

Furthermore, the heater elements can be arranged in any desirable order or configuration. For example, heater element 436 can be positioned adjacent heater element 430, such that the heater element 430 is concentric with respect to the heater element 436. In such an example, the heater element 436 contributes to heating the chamber 404 from above in addition to assisting the heater element 430 in maintaining the fluid heated as it travels through the nozzle 412.

These examples are provided to demonstrate that precise nozzle shapes are achievable and fall within the scope of the claims that follow. Various modifications and combinations of the component arrangements shown herein can be made that fall within the scope of this disclosure. For example, the heater elements' arrangement, size, and number may be combined in various modifications.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device, comprising:
- a substrate;
- a first dielectric layer on the substrate;
- a chamber having a first surface and a second surface defined by the first dielectric layer, the second surface being opposite to the first surface;
- a first heater element positioned in the first dielectric layer and configured to heat the chamber from the second surface;
- a metal layer overlying the first dielectric layer, the metal layer having a first thickness, the metal layer being closer to the first surface of the chamber than to the second surface of the chamber;
- a nozzle through the metal layer exposing the chamber;
- a protection layer overlying the metal layer and on walls of the nozzle, the protection layer having a second thickness at least two times smaller than the first thickness; and
- an inlet path in the substrate, through the first dielectric layer, the inlet path in fluid communication with the chamber, the nozzle, and a surrounding environment.

2. The device of claim 1 wherein the metal layer comprises a metal selected from the group consisting of tungsten, copper, and aluminum.

3. The device of claim 1 wherein the protection layer is gold.

4. The device of claim 1 wherein the nozzle has a first end adjacent to the first surface and a second end adjacent to the surrounding environment and the walls of the nozzle are tapered from the first end to the second end.

5. The device of claim 1 further comprising a second heater element adjacent to the first surface.

6. The device of claim 1, further comprising a second dielectric layer between the chamber and the metal layer.

7. The device of claim 6, further comprising a second heater element in the second dielectric layer, the second heater element being adjacent to the nozzle.

8. A device, comprising:
- a substrate;
- a chamber in the substrate, the chamber having a first surface and a second surface opposite to the first surface;
- a first metal layer overlying the chamber;
- a first heater element configured to heat the chamber;
- a nozzle through the first metal layer, the nozzle having a width and being in fluid communication with the chamber to permit fluid to exit from the chamber, the first surface of the chamber being closer to the nozzle than the second surface of the chamber, the first heater element being configured to heat an area around the nozzle;
- a second metal layer overlying the first metal layer and on walls of the nozzle, the second metal layer having a first thickness that is less than the width of the nozzle; and
- a transistor formed in the substrate adjacent to the chamber and coupled to the first heater element.

9. The device of claim 8 wherein the first metal layer has a second thickness that is at least two times larger than the first thickness.

10. The device of claim 8, further comprising a second heater element that is configured to provide heat to the chamber from the second surface.

11. The device of claim 8, further comprising an inlet path in the substrate in fluid communication with the chamber, the nozzle, and a surrounding environment.

12. A device, comprising:
- a substrate;
- a recess in the substrate;
- a dielectric layer overlying the recess;
- a first metal layer overlying the dielectric layer and the recess;
- a nozzle extending from the recess through the dielectric layer and the first metal layer, the nozzle being configured to permit fluid to exit from the recess; and
- a second metal layer overlying the first metal layer, the nozzle having an interior wall that includes a first portion formed by the second metal layer and a second portion formed by the dielectric layer, the first portion being substantially flush with the second portion.

13. The device of claim 12 wherein the first metal layer has a first thickness and the second metal layer has a second thickness, the first thickness being at least two times larger than the second thickness.

14. The device of claim 12 wherein the second metal layer has a thickness that is less than a width of the nozzle.

15. The device of claim 12, further comprising forming a first heater element adjacent to the chamber and a second heater element adjacent to the nozzle.

16. The device of claim 12 wherein the nozzle has a first end adjacent to the recess that is wider than a second end that is adjacent to a surrounding environment.

17. The device of claim 12, further comprising forming an inlet path in the substrate, the inlet path being in fluid communication with the recess, the nozzle, and a surrounding environment.

* * * * *